United States Patent [19]

Cowen et al.

[11] 4,329,002

[45] May 11, 1982

[54] MANICURE TABLE

[75] Inventors: Theodore A. Cowen, Belvidere; Gary B. Jackovin, Roscoe, both of Ill.

[73] Assignee: Belvedere Company, Inc., Rockford, Ill.

[21] Appl. No.: 175,063

[22] Filed: Aug. 4, 1980

[51] Int. Cl.[3] ..... A45D 29/00; A47B 41/00

[52] U.S. Cl. ..... 312/196; 312/223; 248/118; 132/73; 132/73.5; 108/32

[58] Field of Search ..... 312/196, 194, 195, 223; 108/23, 32; 248/118, 118.1; 132/73, 73.5

[56] References Cited

U.S. PATENT DOCUMENTS

| | | | |
|---|---|---|---|
| 561,562 | 6/1896 | Brownson et al. | 248/118 |
| 591,574 | 10/1897 | Smith | 108/32 |
| 1,115,996 | 11/1914 | Wilson | 312/195 |
| 1,500,649 | 7/1924 | Simonson | 132/73.5 |
| 1,700,202 | 1/1929 | Langford | 312/196 |
| 1,844,698 | 2/1932 | Snyder | 132/73.5 |
| 2,147,314 | 2/1939 | Percy | 132/73 |
| 2,678,489 | 5/1954 | Ratzlaff et al. | 312/196 |
| 3,696,760 | 10/1972 | Riley | 108/32 |

FOREIGN PATENT DOCUMENTS

| | | | |
|---|---|---|---|
| 1330542 | 5/1963 | France | 312/194 |

*Primary Examiner*—Victor N. Sakran
*Attorney, Agent, or Firm*—Vernon J. Pillote

[57] ABSTRACT

A manicure table of the type in which the manicurist and patron sit at opposite sides of the table, the table having a generally horizontal operator top portion along one side and an upwardly inclined patron top portion along the other side disposed at an acute angle to the horizontal for supporting the forearm or the patron and having its upper edge spaced above the operator top portion a distance sufficient to allow the patron's hand to flex at the wrist and extend downwardly from the upper edge of the inclined patron's top portion toward the operator top portion. A manicurist supply and utensil cabinet is advantageously provided at one end of the table. A lamp is advantageously mounted above the table.

6 Claims, 4 Drawing Figures

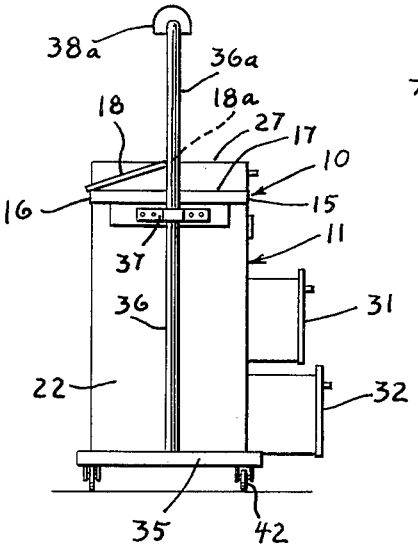
Fig. 1
Fig. 2
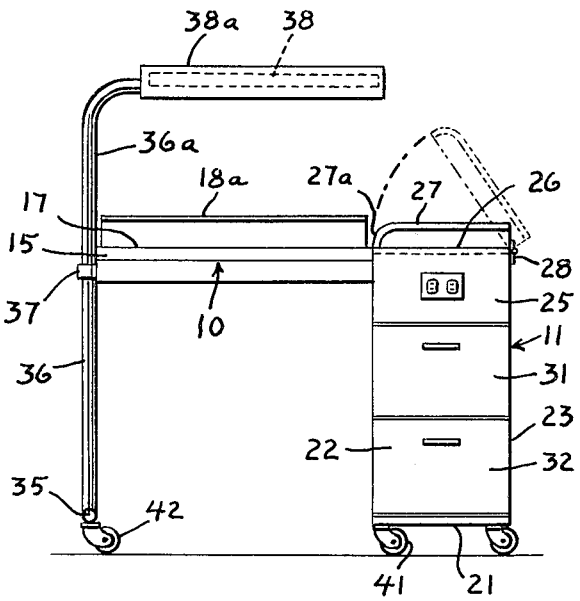
Fig. 3
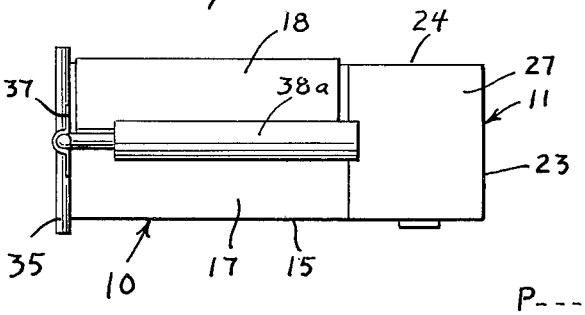
Fig. 4
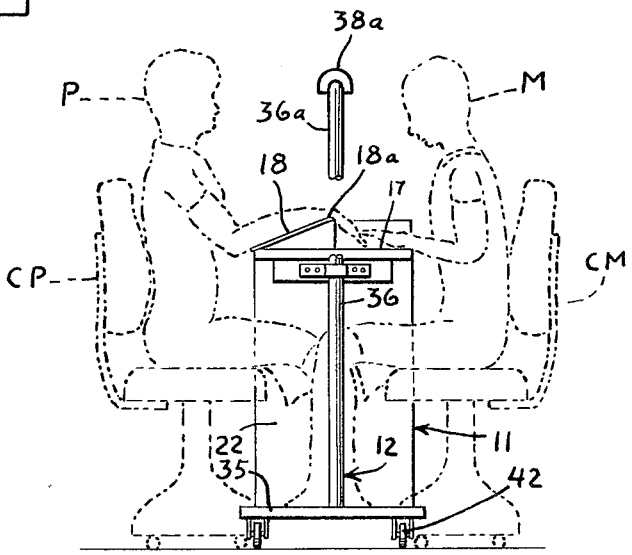

MANICURE TABLE

BACKGROUND

Manicure tables have heretofore been made in which the manicurist and patron sit at opposite sides of a work table in face-to-face relation. However, the prior manicurist tables with which the applicants are aware, had flat work tops and was tiring for a patron getting a manicure to hold their arms and hands in the proper position during the various phases of the manicure including soaking, cleaning, shaping and polishing of the nails.

It is a general object of the present invention to provide an improved manicure table which supports the arms of the patron in such a manner that the patron's arms and hands can remain fully relaxed during the manicure. Accordingly, the present invention provides a manicure table comprising an elongated table top having first and second side edges and means for supporting the table top at locations spaced apart along its length to provide a knee opening below the table top accessible from both sides of the table top, the table top including an operator top portion extending generally horizontally from the first side edge toward the center of the table top, and the table top including an inclined patron top portion extending from the second side edge toward the center of the table top and inclined upwardly at an acute angle to the horizontal for supporting the forearm of the patron and having its upper edge space above the operator top portion a distance sufficient to allow the patron's hand to flex at the wrist and extend downwardly from the upper edge of inclined patron top portion toward the operator top portion.

The manicure table advantageously includes a cabinet at one end of the table top having a top opening to facilitate access to manicure supplies and utensils and a cover mounted for movement into and out of position closing the top opening. A lamp can advantageously be provided at a location intermediate the side edges of the table and spaced above the table a distance to be above eye level.

These, together with other advantages and features of the present invention will be more readily understood from the following description when taken in connection with the accompanying drawings wherein:

FIG. 1 is an end elevational view of the manicure table;

FIG. 2 is a side elevational view of the manicure table;

FIG. 3 is a top plan view of the manicure table; and

FIG. 4 is an end elevational view of the manicure table and with parts broken away to illustrate the table in use.

The invention relates to a manicure table of a type in which a manicurist such as designated M in FIG. 4 and patron such as designated P in FIG. 4 sit on their respective manicure chair and patron chairs CM and CP at relatively opposite sides of the table, and in face-to-face relation. The table top 10 is supported at locations spaced apart along its length to provide a knee opening below the table top which is accessible from both sides from the table top, and the table top is preferably supported at a height of about thirty inches above the floor to provide a comfortable work area for the manicurist when seated. In the preferred embodiment illustrated, the table top 10 is supported by a cabinet structure 11 for receiving and storing different manicurist supplies and utensils, and a leg structure 12 at its other end.

The table top 10 has first and second side edges 15 and 16 and an operator top portion 17 that extends generally horizontally from the first side edge 15 toward the center of the table top to provide a work area for the manicurist M. The table top also includes an inclined patron top portion 18 that extends from the second side edge toward the center of the table top and is inclined upwardly at an acute angle to the horizontal to support the forearm of a patron seated at the other side of the table. The upwardly inclined patron top portion 18 has its upper edge spaced above the operator top portion a distance sufficient to allow the patron's hand to flex at the wrist and extend downwardly from the upper edge 18*a* of the inclined top portion toward the operator top portion. The inclined patron top portion has a width which is preferably about eight inches and somewhat less than the length of the forearm of a patron so that the hand of the patron can project beyond the upper edge 18*a* of the inclined patron top portion, and the inclined patron top portion is disposed at a shallow angle to the horizontal, for example at an angle of about 20° and such that the patron's hand, when relaxed, can flex at the wrist and extend downwardly from the upper edge of the inclined patron portion toward the operator top portion. This supports the patron's hand in a relaxed condition and in a convenient position to allow the patron's nails to soak in a soaking dish disposed on the operator top portion 17. In addition, the patron's hand and wrist are relaxed so that the operator can easily manipulate the hands and fingers as required during cleaning, shaping and polishing of the nails. The overall width of the table top is relatively narrow, for example of the order of sixteen inches, so that the manicurist does not have to work with her arms in an uncomfortable extended position. The patron top portion 18 is advantageously padded and may, if desired, be formed of a wedge shaped pad of resilient foamed material such as rubber or urethane foam which is attached to the table top 10.

The cabinet 11 which supports one end of the table top includes a base 21, upstanding side walls 22 and 23, a rear wall 24 and a front panel 25. The cabinet advantageously is provided with an open top to provide a manicurist supply and storage area at one end of the table top, and, as shown the rear panel 24, side panel 23 and front panel 25 extend to a level adjacent the level of the table top, and the cabinet has an upper shelf 26 disposed adjacent to the level of the table top for supporting the beautician's supplies and utensils. A cover 27 is movably mounted as by a hinge 28 on the side panel 23 for swinging movement into and out of a position closing the top of the cabinet and the cover advantageously is provided with a downwardly extending lip 27*a* at its inner edge. Drawers such as 31 and 32 are provided in the cabinet below the front panel 25 and are movable outwardly at the operator's side of the table top, to provide additional storage area for manicurist's supplies and utensils.

The leg 12 for supporting the other end of the table top can be of any suitable construction, and, as shown, is conveniently formed of tubular metal stock including a base 35 and an upwardly extending leg 36 that is secured by a bracket 37 to one end of the table top 10. The leg 36 is conveniently extended above the table top as indicated at 36*a* and a lamp 38 is mounted in a hood 38*a* on the leg extension 36*a* at a location intermediate the side edges 15 and 16 of the table top and spaced above the table top so as to be slightly above eye level for the patron and the manicurist as shown in FIG. 4. The lamp hood 38*a* is arranged to shade the lamp and direct the rays from the lamp downwardly toward the manicure table, while shielding the manicurist's and patron's eyes from the direct rays of the lamp. The lamp 38 is preferably elongated in the direction of the length of the table as best shown in FIGS. 2 and 3 and may, for example, be of the fluorescent type.

A manicurist table is preferably made portable and casters 41 and 42 are mounted on the cabinet 11 and leg structure 12, to facilitate movement of the manicure table from place to place in the beauty salon.

From the foregoing it is thought that the construction and use of the manicure table will be readily understood. The manicurist and patron sit at relatively opposite sides of the table and the table top is supported at a level such as thirty inches above the floor so that the operator top portion 17 is at a convenient working level for the manicurist. The inclined patron portion 18 underlies and supports the forearm of the patron with the hand of the patron extending beyond the upper edge 18*a* of the inclined patron top portion so that the hand can flex at the wrist when relaxed and extended downwardly toward the operator top portion. This not only provides a comfortable support for the patron's arm when the hand is extended into a soaking dish on the operator top portion, but also allows the patron's hand to be relaxed so that it can easily be manipulated by the manicurist during cleaning, shaping and polishing of the nails.

The embodiments of the invention in which an exclusive property or privilege is claimed are defined as follows:

1. A manicure table of a type in which the manicurist and patron sit at opposite sides of the table in face-to-face relation, the manicure table comprising, an elongated table top having first and second side edges and means for supporting the table top at locations spaced apart along its length to provide a knee opening below the table top accessible from both sides of the table top, the table top including an operator top portion extending generally horizontally from said first side edge toward the center of the table top, said table top including an inclined padded patron top portion extending from said second side edge toward the center of the table top and inclined upwardly at an acute angle to the horizontal for supporting the forearm of the patron in an upwardly inclined position and having its upper edge spaced above the operator top portion a distance sufficient to allow the patron's hand to flex at the wrist in a relaxed condition and extend downwardly from the upper edge of the inclined patron top portion toward said operator top portion.

2. A manicure table according to claim 1 including a lamp having downwardly opening lamp hood, and means mounting the lamp hood at a location intermediate the first and second side edges of the table top and spaced above the table top a distance to be slightly above eye level for the manicurist and patron; the hood being arranged to direct the lamp rays downwardly toward the table while shielding eyes of the manicurist and patron from the direct rays of the lamp.

3. A manicure table according to claim 1 including wheel means on said means for supporting the table top to movably support the manicure table on a supporting surface.

4. A manicure table according to claim 1 wherein said means for supporting the table top includes a cabinet at one end of the table top, said cabinet having a top opening at said one end of the table top, and cover means mounted for movement into and out of a position closing said top opening.

5. A manicure table according to claim 1 wherein said means for supporting the table top includes a cabinet at one end of the table top, the cabinet having a top opening at said one end of the table top and a top shelf at a level adjacent said operator top portion, and cover means mounted for movement into and out of a position closing said top opening.

6. A manicure table of a type in which the manicurist and patron sit at opposite sides of the table in face-to-face relation, the manicure table comprising, an elongated table top having first and second side edges and means for supporting the table top at locations spaced apart along its length to provide a knee opening below the table top accessible from both sides of the table top, the table top having a width of about sixteen inches and including an operator top portion extending generally horizontally from said first side edge toward the center of the table top, said table top including an inclined patron top portion having a width of about eight inches extending from said second side edge toward the center of the table top and inclined upwardly at an acute angle of about twenty degrees to the horizontal for supporting the forearm of the patron in an upwardly inclined position and having its upper edge spaced above the operator top portion a distance sufficient to allow the patron's hand to flex at the wrist in a relaxed condition and extend downwardly from the upper edge of the inclined patron top portion toward said operator top portion.

* * * * *